US006184507B1

(12) United States Patent
Kouno et al.

(10) Patent No.: US 6,184,507 B1
(45) Date of Patent: Feb. 6, 2001

(54) PACKAGE FOR CARBON HEATER USED FOR MANUFACTURING A MONO CRYSTAL BODY AND METHOD OF FORMING THE SAME

(75) Inventors: Tadayoshi Kouno, Ebina; Saburou Tanaka, Tokyo; Akira Masaoka, Yamanashi, all of (JP)

(73) Assignee: Nippon Carbon Co., Ltd., Tokyo (JP)

( * ) Notice: Under 35 U.S.C. 154(b), the term of this patent shall be extended for 0 days.

(21) Appl. No.: 09/429,358

(22) Filed: Oct. 28, 1999

(30) Foreign Application Priority Data

Oct. 30, 1998 (JP) ..... 10-326191

(51) Int. Cl.[7] ..... H05B 3/06

(52) U.S. Cl. ..... 219/542; 219/546; 219/548; 206/303

(58) Field of Search ..... 219/520, 542, 219/546, 548, 200, 201; 206/751, 752, 736, 303, 724, 727, 318, 54, 53, 585

(56) References Cited

U.S. PATENT DOCUMENTS 4,790,430 * 12/1988 Thomas ..... 206/303
5,127,520 * 7/1992 Thomas ..... 206/303

* cited by examiner

*Primary Examiner*—Teresa Walberg
*Assistant Examiner*—Shawntina Fuqua
(74) *Attorney, Agent, or Firm*—Sughrue, Mion, Zinn, Macpeak & Seas, PLLC

(57) ABSTRACT

The invention is related to a package for packing a cylindrical carbon heater, used for manufacturing a mono crystal body and a method of forming the same, in which the cylindrical carbon heater is held sandwiched at the opposite ends between a base member and a plurality of retainer members, and compressive forces are applied independently to different parts of the carbon heater on the base member via the respective retainer members.

7 Claims, 6 Drawing Sheets

PACKAGE FOR CARBON HEATER USED FOR MANUFACTURING A MONO CRYSTAL BODY AND METHOD OF FORMING THE SAME

BACKGROUND OF THE INVENTION

This invention relates to a package of a carbon heater used for manufacturing a mono crystal body and a method of forming the same and, more particularly to a package of a carbon heater, which is used as a heat source provided on an apparaties for manufacturing a silicon mono crystal body, such as electronic device parts or the like, the package being obtained by matching the structure and character of the graphite material, with which the carbon heater are made, and a method of obtaining the same.

The manufacturing of a mono crystal body will now be descried in connection with the manufacturing of a mono crystal body of silicon by using a raising system, such as CZ method. However, the invention is also applicable to carbon heaters used as heat source for manufacturing other mono crystals, such as those of germanium and other metals.

PRIOR ART

In the field of electronic communication equipment, mono crystal bodies of silicon (hereinafter referred to as mono crystals) are used as substrates of semiconductor devices and integrated circuits. Silicon mono crystal is obtained by raising via a seed crystal from a molten silicon bath containing molten polycrystalline silicon as material, that is, it is manufactured by growing in so-called liquid phase epitaxy.

Such silicon mono crystals are mostly manufactured in the CZ method. In the CZ method, a carbon heater, i.e., a heater made of graphite material, is used as a heat source for thermally melting polycrystalline silicon in the case of manufacturing silicon mono crystal by using CZ method. This is done so because the graphite material with use of the carbon heater has the following properties.

(A) Graphite material is not molten under normal pressure, and its sublimation temperature is very high.

(B) Graphite material has very high radiation capacity or about 0.8 or above, i.e., nearly 1.0.

(C) Unlike metallic materials which are softened at high temperatures, the high temperature mechanical strength of graphite material is very high; the strength is increased in proportion to the temperature up to a temperature of 250° C.

(D) Graphite material has adequate electric resistance as resistive heat generator, the resistance increasing in proportion to the temperature at temperatures above 500° C. The material thus has very suitable character as the resistive heat generator.

(E) Graphite material has low thermal expansion coefficients.

(F) Graphite material can be readily freely machined. However, since the machining is liable to result in spoiling of the mechanical strength, imitations are imposed on the method of matching and the structure.

(G) Graphite material is far inexpensive compared to other competitive materials, such as platinum, rhodium, tungsten and molybdenum.

(H) High purity graphite material is less subject to gas generation, and is thus suitable as heat source for silicon single crystal raising, in which the product quality is influenced by gas generation.

The carbon heater makes use of the above properties of graphite material. In the meantime, in the carbon heater considerations are paid to increase the electric resistance within a range free from spoiling the mechanical strength. Specifically, as shown in FIG. 6, the carbon heater is formed as a cylindrical body 2 of graphite material, and its peripheral wall is formed with axial slit-like notches 3 cut from alternate upper and lower ends to define conductive portions 4 between adjacent notches 3. The conductive portions 4 are continuous to one another at the alternate upper and lower ends and constitute a single long conductive part. By forming such conductive part, the electric resistance can be increased, so that a high temperature can be obtained. A pair of current application terminals 5 are provided on the conductive part 45 on the diametrically opposite sides thereof. The terminals 5 project from one end of the body 2. When using the carbon heater as such, it is set with the terminals 5 as legs, so that the afore-mentioned end constitutes the lower end. At the time of the packing, however, the body 2 is inverted, and is put into a packing body with its end with the terminals 5 projecting therefrom as the upper end. Thus, the following description will be made with the end, from which the terminals 5 project, as the upper end. The terminals 5 are angle-like or L-shaped in sectional profile, having portions 51 projecting radially inward or outward. In FIG. 6, the portions 51 are shown projecting radially inward.

The carbon heater having the above structure can serve as a very excellent resistive heat generator. However, since it is made of graphite material and has the continuous long conductive part 4, which is defined by a plurality of axial slit-like notches 3, it will be readily broken by slight shocks or external forces that are experienced. Particularly, the current application terminals 5 which project from the upper end of the body 2 will be broken or damaged even by slight external forces.

In the case when moving the carbon heater having such a shape to a storage site or a site of use or shipping the carbon heater as a product, considerable cares should be exercised in the packing.

Accordingly, various packages of and methods of packing the above carbon heater have been proposed.

In one example of Method, since the carbon heater is cylindrically hollow in shape, it is put in a box by reinforcing it with buffering materials of indefinite shapes or like fillers fitted in its inside. However, the carbon heater has a diameter of 30 to 10 cm and a height of 30 to 80 cm, and thus requires a great quantity of fillers. A problem is thus posed in connection with the discarding of used fillers.

In addition, in the above packing method it is impossible to protect the pair current application terminals, which project from the upper end of the carbon heater and are very weak in mechanical strength.

Japanese Patent Laid-Open No. 5-51065 proposes packing core materials used for protecting a carbon heater as shown in FIG. 6. In this case, the core materials are accommodated in the cylindrical body of the carbon heater. Japanese Patent Laid-Open No. 5-51086 proposes carbon heater packing vessels with such core materials inserted therein.

The former proposed core material is a one-piece resin foam member, which is cylindrical such as to be able to be alignedly set in a cylindrical body of a carbon heater and has a lower end flange for supporting the lower end surface of the carbon heater body.

However, this one-piece resin foam core material is light in weight and merely inserted in the carbon heater for reinforcement thereof, and basically does not protect the carbon heater against external forces applied thereto during transport.

In addition, the former proposed core material is considerably voluminous when applied to carbon heaters, and therefore poses considerable problems in its discarding after use.

The latter proposed packing vessel has an integral structure comprising a vessel body for accommodating a carbon heater and pallet member mounted on the underside of the vessel body and having a fork-lift pawl inserting portion.

This packing vessel, however, aims at logical and machinerized carbon heater conveying operations, and is not intended to directly protect a carbon heater during the transport thereof.

SUMMARY OF THE INVENTION

The invention seeks to solve the above problems resulting from use of the conventional packing of the carbon heater, and it has an object of providing a good package of a carbon heater used for manufacturing a mono crystal body by CZ method. The package is obtainable by making effective use of the property of graphite material with which of the carbon heater is manufactured, and free from the conventional environment problems in the discarding of shock absorbing materials and like packing materials. Furthermore, the package is capable of being safely transported to the customer or the like and capable of being easily unpacked by the customer, and also a method of forming the same.

The package according to the invention has thereon an integral structure obtainable by axially compressing a cylindrical carbon heater intervening between a base member and a plurality of retainer members.

One retainer of the plurality of the retainer members is adapted to axially compress and clamp the carbon heater at the ends thereof exclusive of current application terminals.

The other retainer of the retainer members is adapted to axially compress and clamp the current application terminals.

The other retainer member is provided at the opposite ends thereof with projections, the projections being adapted to axially compress and clamp portions of the current application terminals of the carbon heater.

The first-mentioned one retainer member has at least two notches. Via these notches, the projections of the other retainer member axially compress and clamp the current application terminals of the carbon heater.

In such a package, in which the carbon heater is packed by making use of the property of graphite material and by application of sole compressive forces (and without any tensile stress generation), the carbon heater is quite free from breakage.

In addition, the packing requires no filler or the like for breakage prevention, and it is thus possible to reduce necessary packing materials and preclude industrial discarding of materials.

In detail, the package according to the invention is a carbon heater for manufacturing a mono crystal body by using CZ method. The package has an integral structure obtainable by applying compressive forces to different parts of the carbon heater intervening between a base member and a plurality of retainer members, in the direction of the axis of the carbon heater.

The retainer members include a first retainer member for axially compressing and retaining the body of the carbon heater excluding current application terminals thereof, and a second retainer member for axially compressing and retaining only the current application terminals.

The second retainer member has projections formed at the opposite ends for axially compressing and clamping parts of the current application terminals of the carbon heater.

The first retainer member has notches for accommodating the current application terminals of the carbon heater.

Furthermore, there is provided with a coupling member for coupling and fastening together the first retainer member and the base member and with a fastening member for fastening the second retainer member to the first retainer member and applying an axial compressive force to the current application terminals of the carbon heater.

Additionally, a method of forming a package of a carbon heater according the invention comprises steps of clamping a cylindrical carbon heater by setting the carbon heater on a base member, setting one of a plurality of retainer members on the upper end surface of the carbon heater and applying an axial compressive force to a body part of the carbon heater exclusive of current application terminals thereof, fastening another one of the retainer members to the first-mentioned retainer member, and axially compressing and clamping the current application terminals, thereby forming the carbon heater package.

BRIEF DESCRIPTION OF THE DRAWINGS

The above structure and functions according to the invention will become more apparent from the embodiment thereof illustrated in the drawings, in which.

DETAILED DESCRIPTION OF THE PREFERRED EMBODIMENT

Figure 6:
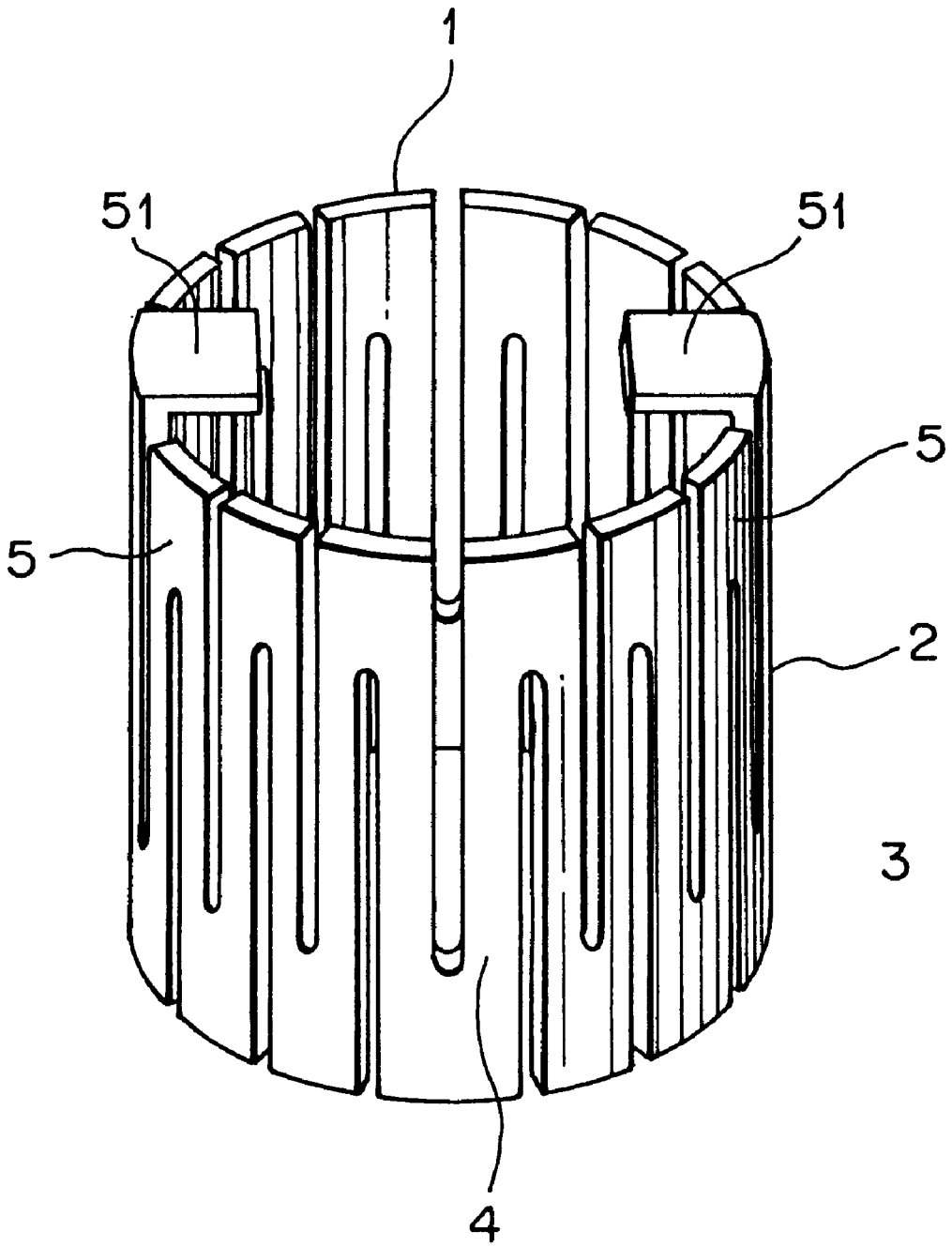
FIG. 6 is a perspective view showing a prior art carbon heater.

FIG. 6 is a cylindrical body 2 of a carbon heater 1 to be packed. The cylindrical body 2 is made of graphite material, and its peripheral wall has a number of axial slit-like notches cut from alternate upper and lower ends to define conductive portions 4 between adjacent notches 3. The conductive portions 4 are continuous to one another at the alternate upper and lower ends and constitute a single conductive part 4. The carbon heater is thus constituted by the continuous conductive part as a long resistive heat generator.

A pair of current application terminals 5 are mounted on the conductive part 4 on the diametrically opposite sides thereof. When the continuously long conductive part 4 is energized via the conductive terminals 5, it resistively generates heat. Thus, heat is provided as desired for the single crystal raising.

The conductive terminals 5 are ange-like or L-shaped in sectional profile, and have portions 51 projecting radially inward or outward from the upper end of the three-dimensionally cylindrical peripheral wall of the body 2. Because of low oblique bending strength of the graphite material, therefore, the current application terminals are very readily broken by external forces applied to the radially inwardly or outwardly projecting portions 51 during transport or in like situations.

According to the invention, the carbon heater 1 having the above structure, comprising the cylindrical body 2 with the current application terminals 5 having the radially inwardly or outwardly projecting portions 51, is packed to obtain a single package as follows.

Figure 1:
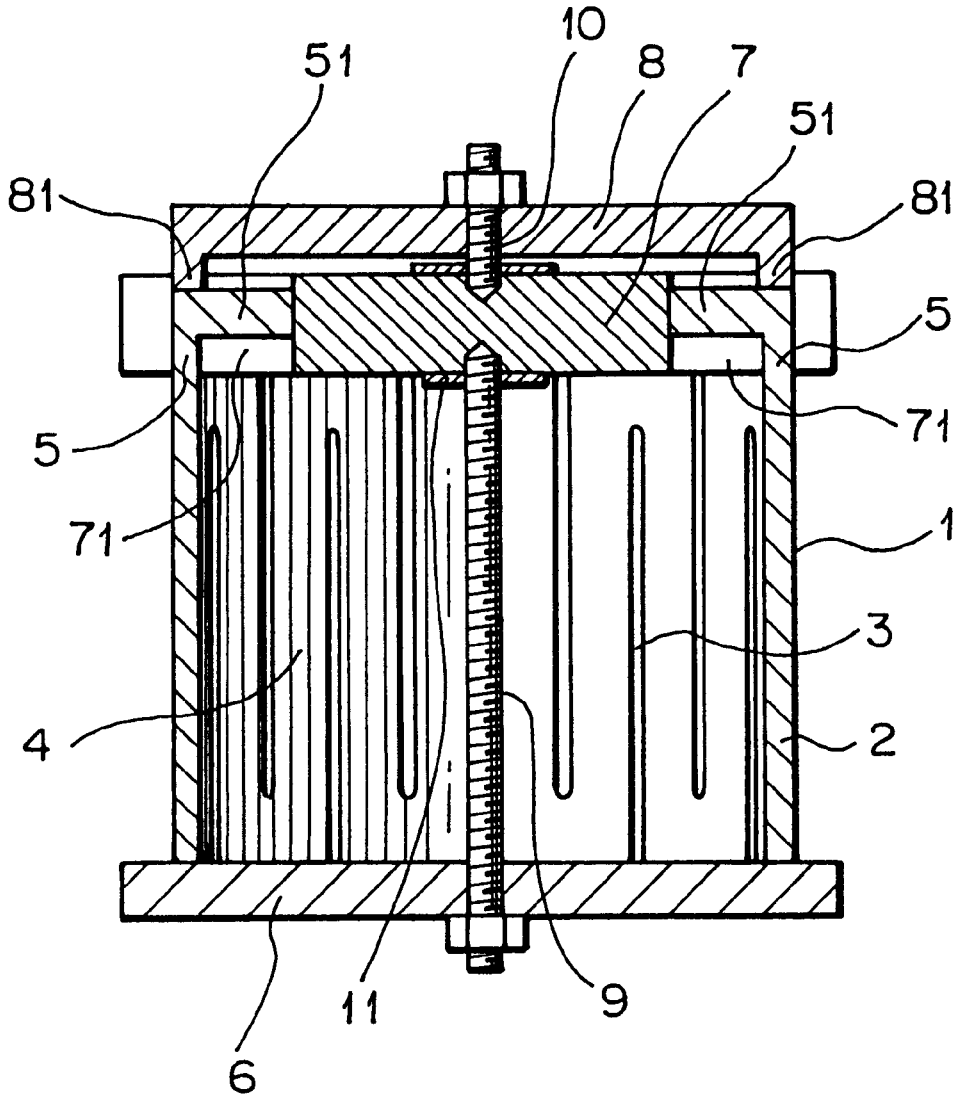
FIG. 1 is a front view, partly in section, showing an embodiment of the package according to the invention.

Referring to FIG. 1, the carbon heater 1 to be packed is first held sandwiched between a base member 6 on one hand and a plurality of retainer members, particularly retainer members 7 and 8, on the other hand.

In this state, the conductive part 4 and the two current application terminals 5 of the carbon heater 1 are independently clamped by compression.

By axially clamping the carbon heater 1 with the base member 2 and a plurality of retainer members such as the members 7 and 8 in the above way, it is possible to readily pack the carbon heater 1 by making use of the property of the heater although the heater is made of the graphite material.

The graphite material of the carbon heater 1 can be freely machined, although it is said that the mechanical strength of the material is low.

Among the variety of mechanical strength, the tensile strength, the bending strength and the compressive strength are considerably set apart from one another. Among these mechanical strengths, the compressive strength is very high, and the invention is predicated in this fact.

Specifically, the graphite material is low in tensile strength, and its bending strength and compressive strength are higher than the tensile strength in the mentioned order. By way of example, assuming the tensile strength to be unity, double the tensile strength is the bending strength, and double the bending strength is the compressive strength. Among the various mechanical strengths the compressive strength is outstandingly high. The graphite material thus permits formation of a package by applying considerably high compressive force so long as the sole compressive force is applied to obtain the package.

According to the invention, the property of the graphite material is utilized, and a package is obtained by applying the sole axial compressive force to the carbon heater from the consideration of the special shape of the carbon heater itself. As a technical means to realize this, the carbon heater 1 is packed by setting it on the base member 6 and applying axial compressive forces to its different portions via respective retainer members 7 and 8. Naturally, this package has an integral structure which is obtained as a result of application of the sole compressive forces to the different parts of the carbon heater 1. Thus, external forces applied to the integral package during transport, are received by the upper and lower base members and the retainer members and not applied to the packed carbon heater, which is thus free from breakage.

As described above, the carbon heater 1 comprises the cylindrical body 2 and the current application terminals 5 projecting from the upper end of the body 2, the body 2 having the slit-like notches 3 splitting the same in the axial direction such as to form the continuous long conductive part 4, and the current application terminals 5 mounted on the conductive part 4 on diametrically opposite sides thereof and projecting from the upper end of the body 2.

To such carbon heater 1 which has many raised and depressed portions, only axial compressive forces should be applied in the entirety. Particularly, the forces applied to the current application terminals 5 at the time of the packing should be sole axial compressive forces applied to the upper end of the body 2. To this end, the conductive part 4 and the terminals 5 should be packed independently on the base member 6 with the respective retainer members 7 and 8.

In other words, the external forces applied at the time of the packing are mostly an axial compressive force applied to the body 2 of the carbon heater 1. Thus, considerably great forces can be applied to the carbon heater 1 between the retainers 7 and 8 on one hand and the base member 6 on the other hand to obtain an integral structure.

Such application of axial forces at the time of the packing requires the use of a plurality of retainer members, i.e., at least the retainer members 7 and 8 in this embodiment, in dependence on the shape of the carbon heater. Preferably, the plurality of retainer members, i.e., the retainer members 7 and 8 in this embodiment, are adapted to be assembled together, and the carbon heater 1 is sandwiched between and made integral with the plurality of retainer members, i.e., the retainer members 7 and 8, and the base member 6.

Figure 2:
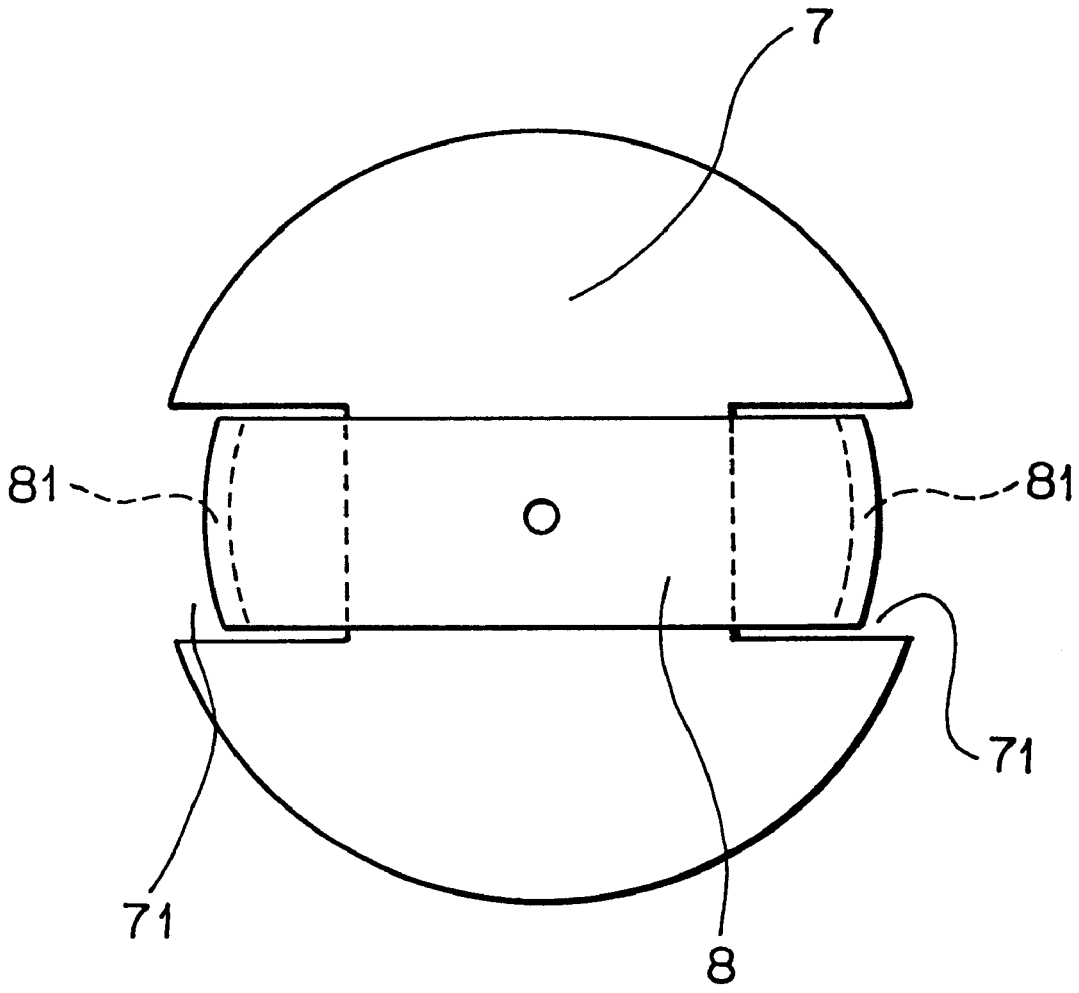
FIG. 2 is a plan view showing the package shown in FIG. 1.

The retainer member 7 (see FIG. 4) is used to compressively clamp only the conductive part 4 of the body 2, and the other retainer member 8 (see FIG. 5) is used to clamp the current application terminals 5 provided on diametrically opposite sides of the body 2. These retainer members 7 and 8 are assembled together (see FIG. 2).

Figure 4:
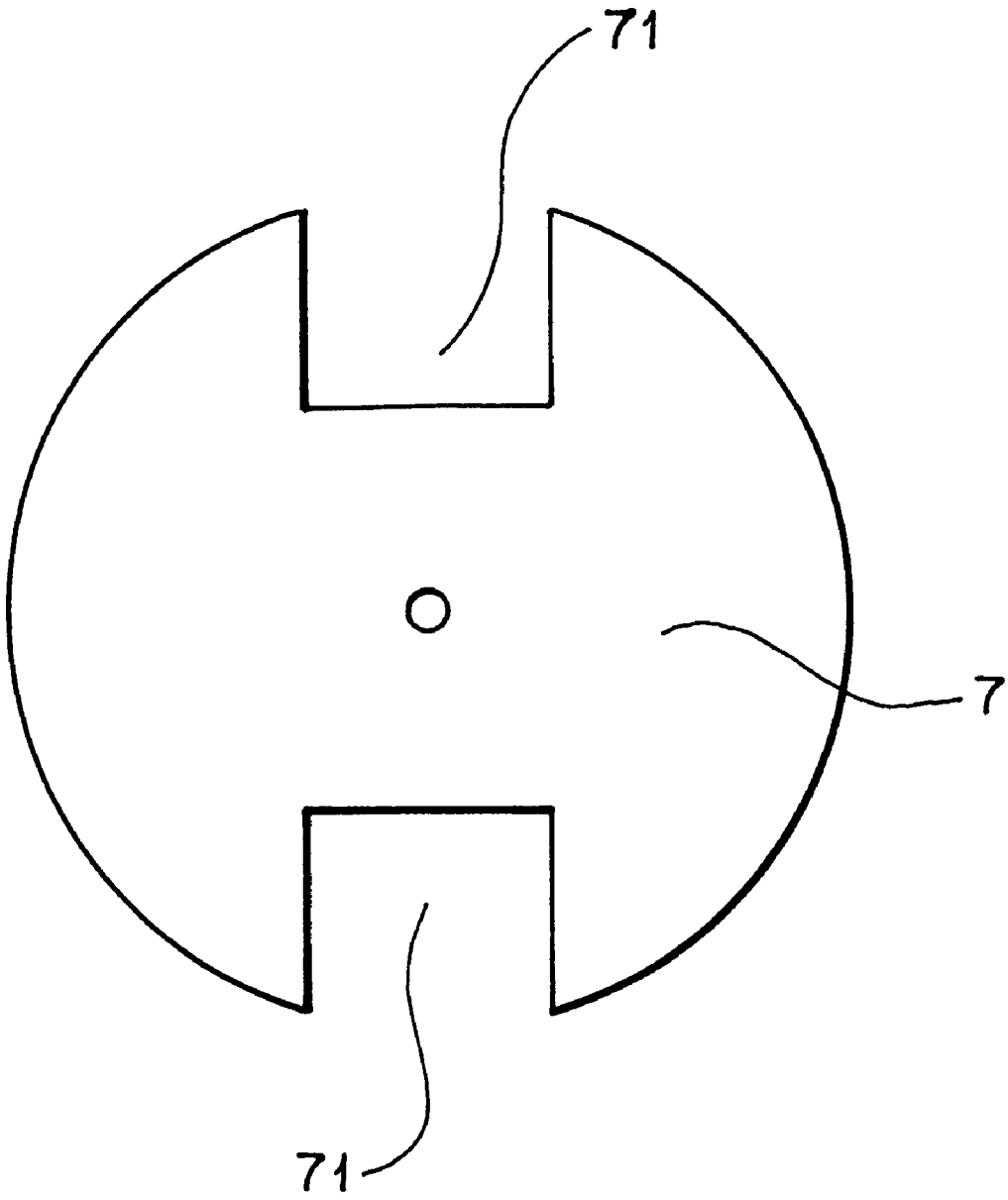
FIG. 4 is a plan view showing an example of one of two retainer members.
Figure 5:
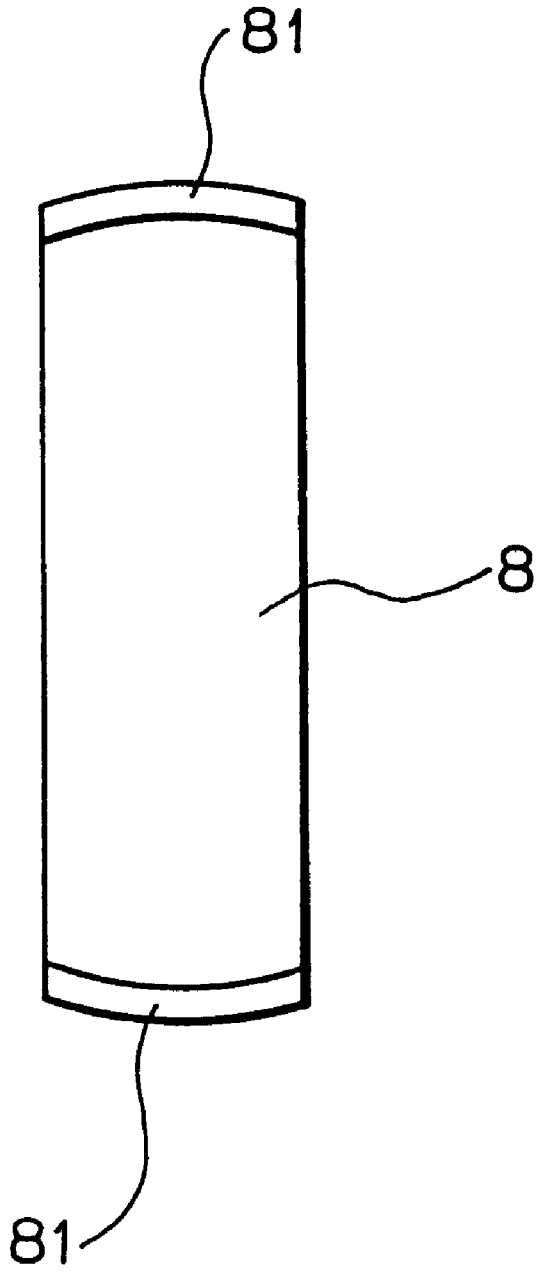
FIG. 5 is a bottom view showing the other one of the retainer members.

As shown in FIG. 4, the retainer member 4 is usually formed form a disc-like member. As shown in FIG. 5, the retainer member 6, on the other hand, is formed as a plate-like member. The retainer members 7 and 8 may be formed from such materials as synthetic resins, wood and iron or from aluminum or like light metal plates, but they may also be formed from any other material so long as it is possible to apply axial compressive forces.

The retainer member 7 has at least two notches 71. The other retainer member 8 has two raised portions 81 formed on the bottom surface. The raised portions 81 are formed such that they extend in the notches 71 when the two retainer members 7 and 8 are assembled together, so that axial compressive forces can be applied to the current application terminals 5 via the retainer member 8. As show in FIG. 5, the retainer members are preferably arcuate in shape.

More specifically, the retainer members 7 and 8 are assembled together by fitting the raised portions 81 from above in the notches 71 of the retainer member 7. In this state, the raised portions 81 penetrate the notches 71, thus permitting application of axial compressive forces to the current application terminals 5 via the retainer member 8.

The notches 71 of the retainer member 7 may sufficiently be large enough to accommodate the projecting current application terminals 5. Where the current application terminals 5 are formed such that they extend in the radial direction of the cylindrical body 2 toward their free ends, the notches 71 preferably restrict the free ends of the projecting portions 51 of the terminals 5.

Where the carbon heater is packed applying sole vertical compressive forces, unless the free ends of the current application terminals 5 are restricted by the notches 71, sliding of the retainer member 8 will be caused during transport by parallel forces applied perpendicularly to the axial direction of the cylindrical body 2. Such sliding of the retainer member 8 generates bending stress in support portions of the current application terminals 5, i.e., coupling portions of the conductive part 4, and consequently the current application terminals 5 may be broken. Such sliding is eliminated by the notches 71 which are formed in the manner as described above.

The raised portions 81 of the retainer member 8 need not be formed such that they can push the entire surfaces of the radially projecting portions 51. Accordingly, the portions 81 are provided on the retainer member 8 at the opposite ends thereof. Preferably, these portions are formed arcuately.

As described before, the current application terminals 2 are angle-like or L-shaped in sectional profile having the portions 51 radially projecting from the upper end of the cylindrical body 21. If compressive forces are applied to the projecting portions 51 at the time of the packing, the current application terminals 5 will be readily broken by experiencing great bending moment. Accordingly, the raised portions 81 are formed such positions that they are found right above the upper end of the peripheral wall of the body 2, so that downward compressive forces applied to the current application terminals 5 via the retainer member 8 are transmitted as axial compressive forces to the body 2.

Figure 3:
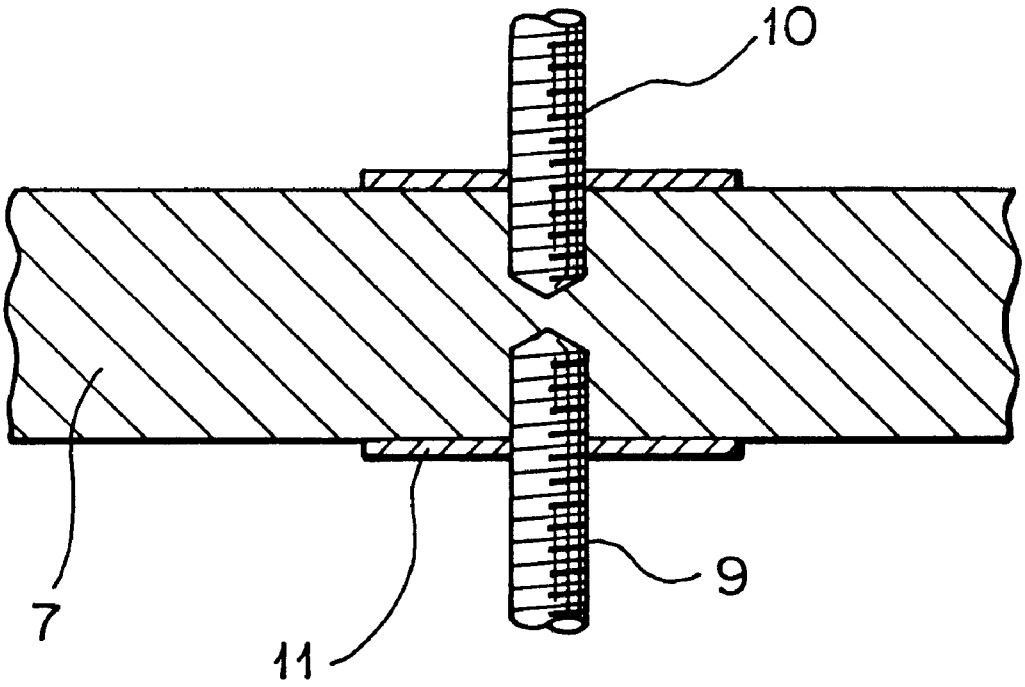
FIG. 3 is an enlarged view showing portion A in FIG. 1.

When packing the carbon heater by application of compressive forces to the body 2 and the current application terminals 5 via the retainer members 7 and 8, the compressive forces may be applied in any desired method. For forming a package having a compact structure, as shown in FIGS. 1 and 3, the base member 6 and the retainer member 7 are coupled together and made integral via a coupling bolt 9, and the axial compressive forces are applied via the coupling bolt 9.

Also, the retainer member 8 is pushed downward against the retainer member 7, thus applying the axial compressive forces. This pushing force is usually applied by using a fastening bolt 10. Specifically, the fastening bolt 10 is screwed in a central portion of the retainer member 8, and is fastened to apply the pushing force. By so doing, compressive forces can be applied to the opposite end raised portions 81 with a great moment. In addition, since the point of application of the pushing force is the center of the retainer member 8, the same compressive forces can be applied to the opposite end raised portions 81, and a balanced package can be obtained.

While the above example of carbon heater had two current application terminals 5, depending on the carbon heater three or more, for instance four, current application terminals may be provided. In such a case, projections 81 may be provided on the retainer member 8 in the number corresponding to the number of the current application terminals 5, and also the corresponding number of notches 71 may be provided on the retainer member 7. By so doing, a package may be obtained in the same manner as described above.

The package having the structure as described above will be described in greater details in connection with the packing of a carbon heater.

As shown in FIG. 6 a cylindrical carbon heater 1 to be packed is set on the base member 6.

Then, as shown in FIG. 1, the retainer member 7 is set on the upper end of the body 2 of the carbon heater 1, excluding the projecting portions 51 of the current application terminals 5, on the base member 6. Specifically, the retainer member 7 is fitted such that the current application terminals 5 projecting from the upper end of the carbon heater 1 are accommodated in the notches 71 of the retainer member 7.

In this state, the coupling bolt 9 is passed through the base member 6 and screwed in the retainer member 7, and is fastened to clamp and apply compressive force to the body 2, i.e., the conductive part 4, of the carbon heater 1.

Subsequently, the retainer member 8 is set on the current application terminals 5, which are now accommodated in the notches 71 of the retainer member 7, such that the raised portions 81 are in contact with the portions of the terminals right above the upper end of the body 2.

In this state in which the opposite end raised portions 1 are in contact with the current application terminals 5, the fastening bolt 10 is fastened, thus fastening the retainer member 8 to the retainer member 7 with a moment provided by the fastening force (see FIG. 3).

In the above packing of the carbon heater 1, the body 2, i.e., the conductive part 4, is clamped with a downward compressive force applied to it via the retainer member 7, and by fastening the retainer member 8 to the retainer member 7 the projecting portions 51 of the current application terminals 5 are clamped also with a downward compressive forces applied to them.

The retainer member 7 is preferably set via a washer 11 or the like. With the retainer member 7 set via the washer 7, the clamping force applied to the when clamping the retainer member 8 to the retainer member 7, is reliably transmitted to the raised portions 81, so that the retainer member 8 can be reliably clamped.

When the packing is done in the manner as described above, the forces applied for obtaining the integral structure of the package are directed only in the axial direction of the carbon heater, and no force is applied in other directions at all.

Thus, no bending or tensile stress or like stress is generated in the individual parts of the carbon heater. In addition, the package has an integral structure with the base member and the plurality of retainer members as protecting members. Thus, the packed carbon heater will not be broken even by considerably great external forces applied to it.

As has been described in the foregoing, in the package of a carbon heater for single crystal rising and the method for forming the same according to the invention, the cylindrical carbon heater is held sandwiched at the opposite ends between the base member and a plurality of retainer members, and compressive forces are applied independently to different parts of the carbon heater in the base member via respective retainer members, thus obtaining an integral structure.

Thus, according to the invention the carbon heater is packed by making use of the property of graphite material and by applying sole compressive forces (without any tensile stress generation), and the packed carbon heater is quite free from breakage.

In addition, no filler or the like for breakage prevention is necessary for the packing, and it is thus possible to reduce necessary packing materials and preclude industrial discarding of materials.

What is claimed is:

1. A package of a cylindrical carbon heater used for manufacturing a mono crystal body, which has an integral structure obtainable by sandwiching the cylindrical carbon heater between a base member and a plurality of retainer members, in such a manner that compressive forces are applied to individual portions of the carbon heater intervening between the base member and the retainer members in the direction of the axis of the carbon heater.

2. The package of a carbon heater used for manufacturing a mono crystal body according to claim 1, wherein the retainer members include a first retainer member for applying axial compressive forces to the marginal area of the carbon heater excluding current application terminals thereof, and a second retainer member for applying axial compressive forces to the current application terminals thereof.

3. The package of a carbon heater used for manufacturing a mono crystal body according to one of claim 2, wherein the second retainer member is provided at the opposite ends with projections for axially compressing the current application terminals of the carbon heater.

4. The package of a carbon heater used for manufacturing a mono crystal raising according to one of claim 2, wherein the first retainer member has notches for accommodating the current application terminals of the carbon heater.

5. The package of a carbon heater used for manufacturing a mono crystal body according to claim 2, which further comprises a coupling member for coupling and fastening together the first retainer member and the base member.

6. The package of a carbon heater used for manufacturing a mono crystal body according to claim 2, which further comprises a fastening member for fastening the second retainer member to the first retainer member and applying an axial compressive force to the current application terminals of the carbon heater.

7. A method of forming a package of a carbon heater used for manufacturing a mono crystal body, in which said method comprises steps of positioning a cylindrical carbon heater on a base member, setting one of a plurality of retainer members on the upper end surface of the carbon heater positioned on the base member, applying an axial compressive force to marginal area of the carbon heater exclusive of current application terminals thereof, and axially compressing the current application terminals.

* * * * *